US010427190B2

(12) United States Patent
Huber et al.

(10) Patent No.: US 10,427,190 B2
(45) Date of Patent: Oct. 1, 2019

(54) SORTING OUT MINERAL-CONTAINING OBJECTS OR PLASTIC OBJECTS

(71) Applicant: Binder + Co AG, Gleisdorf (AT)

(72) Inventors: Reinhold Huber, Furstenfeld (AT); Reinhard Taucher, Graz (AT)

(73) Assignee: Binder + Co AG, Gleisdorf (AT)

( * ) Notice: Subject to any disclaimer, the term of this patent is extended or adjusted under 35 U.S.C. 154(b) by 0 days.

(21) Appl. No.: 15/302,296

(22) PCT Filed: Mar. 9, 2016

(86) PCT No.: PCT/AT2016/050053
§ 371 (c)(1),
(2) Date: Oct. 6, 2016

(87) PCT Pub. No.: WO2016/141398
PCT Pub. Date: Sep. 15, 2016

(65) Prior Publication Data

US 2018/0001352 A1 Jan. 4, 2018

(30) Foreign Application Priority Data

Mar. 9, 2015 (AT) ..... GM50038/2015

(51) Int. Cl.
*B07C 5/342* (2006.01)

(52) U.S. Cl.
CPC ..... *B07C 5/3427* (2013.01); *B07C 5/3425* (2013.01)

(58) Field of Classification Search
CPC .... B07C 5/3422; B07C 5/3425; B07C 5/3427
(Continued)

(56) References Cited

U.S. PATENT DOCUMENTS 3,305,089 A 2/1967 Fraenkel
3,472,375 A * 10/1969 Mathews ..... B07C 5/362 209/3.1
(Continued)

FOREIGN PATENT DOCUMENTS

AT 384563 B 5/1987
CH 699123 A2 1/2010
(Continued)

OTHER PUBLICATIONS

Binder + Co AG, "International Search Report" PCT/AT2016/050053 filed Mar. 9, 2016, 6 pages, english Translation, 2 pages.
(Continued)

*Primary Examiner* — Joseph C Rodriguez
(74) *Attorney, Agent, or Firm* — McKee, Voorhees & Sease, P.L.C.

(57) ABSTRACT

A method and a sorting plant for sorting out mineral-containing objects car plastic objects from a single layer material stream is shown. Here it is provided that

- objects (12) of the material stream are irradiated with stimulating light and the resulting fluorescent light is detected in the form of an image of the fluorescent points,
- the objects of the material stream are irradiated with object detection light outside the fluorescent light, and the transmitted light after passage between the objects or the reflected light of the objects is detected in the form of an image of the individual objects,
- an object is then defined as containing at least one specific mineral or one specific plastic if the fluorescent light of said object lies in a predetermined intensity range for at least one predetermined wavelength range, and
- the so defined objects are separated from other objects of the material stream.

16 Claims, 4 Drawing Sheets

(58) Field of Classification Search
USPC ..... 209/576, 577
See application file for complete search history.

(56) References Cited

U.S. PATENT DOCUMENTS

| | | | | |
|---|---|---|---|---|
| 3,795,310 | A * | 3/1974 | Buchot et al. | B07C 5/3427 |
| 4,423,814 | A * | 1/1984 | White | B07C 5/3427 209/3.3 |
| 4,462,495 | A * | 7/1984 | McKinley | B07C 5/366 209/3.3 |
| 5,024,753 | A * | 6/1991 | Chriswell | B03B 13/02 209/1 |
| 5,512,758 | A * | 4/1996 | Kobayashi | G01N 21/645 250/458.1 |
| 5,966,217 | A | 10/1999 | Roe et al. | |
| 6,753,957 | B1 * | 6/2004 | Graft | G01N 21/718 356/318 |
| 7,449,655 | B2 * | 11/2008 | Cowling | B07C 5/3425 209/577 |
| 7,763,820 | B1 | 7/2010 | Sommer, Jr. et al. | |
| 7,786,401 | B2 * | 8/2010 | Valerio | B07C 5/368 209/143 |
| 7,787,111 | B2 * | 8/2010 | Kim | G01N 21/64 250/461.1 |
| RE42,090 | E * | 2/2011 | Bruner | B07C 5/342 209/577 |
| 8,766,129 | B2 * | 7/2014 | Kazakov | B07C 5/342 209/589 |
| 8,875,901 | B2 * | 11/2014 | Wellwood | B07C 5/368 209/552 |
| 9,126,236 | B2 * | 9/2015 | Roos | B07C 5/3416 |
| 2007/0029232 | A1 * | 2/2007 | Cowling | B07C 5/3425 209/577 |
| 2013/0274914 | A1 | 10/2013 | Umemura et al. | |

FOREIGN PATENT DOCUMENTS

| | | | |
|---|---|---|---|
| DE | 102009057119 | A1 | 6/2011 |
| DE | 10 2010 030 908 | A1 | 1/2012 |
| EP | 0130715 | A2 | 1/1985 |
| EP | 0497397 | A1 | 8/1992 |
| EP | 2395345 | A2 | 12/2011 |
| WO | 2008085945 | A1 | 7/2008 |
| WO | 2011020628 | A1 | 2/2011 |
| WO | 2012001133 | A2 | 1/2012 |
| WO | 2016141398 | A1 | 9/2016 |

OTHER PUBLICATIONS

Opposition in European Patent Office by Binder + Co AG, in connection with patent 16716453.2, (including attached references 1) Wikipedia, "Quarz", 15 pages, dated Apr. 18, 2019.

Opposition in European Patent Office by Binder + Co AG, in connection with Austria application 16716453.2, (including attached references 1) Rompp Lexikon, Chemie, 10. Auglage, A-CL, 2) Corundum, https://www.geo.utexas.edu/courses.347k/redesign/Gem_Notes/Corundum/corundum_main.htm, 3) Rompp Lexikon, Chemie, 10, Auflage, H-L, 4) Merkel et al., "Taschenbuch der Werkstoffe", 27 pages, dated Apr. 24, 2019.

* cited by examiner

SORTING OUT MINERAL-CONTAINING OBJECTS OR PLASTIC OBJECTS

FIELD OF THE INVENTION

This invention concerns a method for sorting out mineral-containing objects or plastic objects from a single layer material stream, and a corresponding sorting plant.

Mineral-containing objects can be mineral intermediate or end products such as rock pieces or fragments, stones, sand, ores, refractory materials (for example, refractory fragments from a blast furnace). A specific object in this case can contain only the desired minerals or mineral phases (this is also called the valuable mineral), can contain the desired minerals in some parts, or can even contain no desired minerals at all. Of course, the objects can be clumped together and even contain a number of different minerals or mineral phases (for example fluorite/barite/quartz), and can be sorted only with regard to the content or proportion of a specific mineral (or plurality of specific minerals).

"Single layer" means that the individual objects do not lie on one another, but rather lie side by side, thus do not excessively overlap each other. It is best if the individual objects are spaced apart from each other, in order to be able to be readily recognized as individual objects by optical devices.

The material stream can consist solely of mineral-containing objects, but it is also conceivable that the mineral stream will also contain other objects in addition to the mineral-containing objects.

However, the method according to the invention is also suitable for sorting plastics or plastic waste. In this case, the single layer material stream can consist only of plastics or plastic waste and objects that consist of one or more specific plastics or that contain one or more plastics as components are sorted out. Of course, however, the single layer material stream can also contain other objects that are not made of plastic.

Even though it is not excluded that sorting is performed both with regard to specific materials and also with regard to specific plastics in one method, in practice it is probable that either only specific minerals or only specific plastics will be sorted out.

BACKGROUND OF THE INVENTION

Specific properties of material intermediate or end products such as the color purity, the impurity content, or the degree of whiteness can be detected using visible light and optical sensors and used for purposes of sorting out.

However, frequently, simple detection of the surface color cannot be used, since there is not a sufficient correlation between the surface color and the desired property, such as the content or proportion of a specific mineral. Alternatively, one can then use costly detection methods like X-ray fluorescence analysis (in this regard see U.S. Pat. No. 7,763,820 B1, for example) or NIR (near infrared) spectroscopy.

Basically speaking, it is known that mineral deposits, whose decomposition product consists of minerals or mineral phases, exhibit fluorescence properties. For instance, chalcedony exhibits green fluorescence, fluorite exhibits blue or yellow fluorescence, and calcite exhibits red fluorescence. With the exception of a few minerals such as the tungsten ore scheelite, fluorescence is not an inherent property of the individual minerals, but rather is dependent on the origin and thus is for the most part deposit-specific. A specific fluorescence property is essentially defined by the crystal structure and crystal lattice defects in which activators such as rare earth elements or transition metals are incorporated.

For this reason, fluorescence is also used for analysis of minerals, mineral resources, or mineral-containing rocks, for example, in laser-induced fluorescence (LIF). This method is also a spectroscopic method and for this reason would be too costly and time intensive for use in industrial sorting.

It is also known that plastics have fluorescence properties. US 2013/274914 A1, for instance, concerns the sorting of plastic parts, including fluorescent plastic parts, by means of radiation. DE 10 2010 030908 A1 in turn shows a method for classification of objects contained in seeds, where the fluorescence property is utilized.

SUMMARY OF THE INVENTION

Therefore, it is an aim of this invention to make available a method and a corresponding sorting plant, where objects that contain a specific mineral or a specific plastic can be detected in a single layer material stream as cheaply as possible and can be separated from other objects that contain little or none of the specific mineral or plastic.

This aim is solved by a method according to claim 1 in that

- objects of the material stream are irradiated with a stimulating light and the resulting fluorescent light is detected in the form of an image of the fluorescent points,
- the objects of the material stream are irradiated with object detection light outside of the fluorescent light and the transmitted light, after passing through the space between the objects, or the reflected light of the objects is detected in the form of an image of the individual objects,
- an object is then defined as containing at least one specific mineral or one specific plastic if the fluorescent light of said object, for at least one predetermined wavelength range, lies in a predetermined intensity range, and
- that objects so defined are separated from other objects of the material stream.

Fluorescence can be stimulated by UV light, and the fluorescent light then as a rule lies in the visible range. Correspondingly, it can be specified that the stimulating light in the method according to the invention is UV light.

However, there are also materials in which fluorescence is stimulated by visible light. Correspondingly, it can be specified that the stimulating light in the method according to the invention is visible light. For instance, ruby or corundum exhibit fluorescence when they are irradiated with green light at about 500 nm wavelength.

It is therefore sufficient to visually image the objects to be tested and on the one hand to analyze the fluorescent points in a first image to see if they have the desired color (for example, by means of a filter in front of an optical camera) and the required intensity. If this is the case, then said fluorescent points correspond to the corresponding object, which is defined by a second image, to a region of the object that contains the specific mineral, namely the desired mineral, or to the specific plastic, and said object can be defined as valuable and can be separated from the other objects. As a rule, the first and second images contain a plurality of objects to be tested.

Since each valuable mineral or each plastic that is to be sorted out is best stimulated to fluoresce by light of a specific wavelength, the stimulating light is to be selected correspondingly, for example by appropriate light sources. If the stimulation peak for a specific material occurs at a specific wavelength, for example at 320 nm wavelength, the stimulating light interval is set, for example, at ±50 nm, thus, for example, at 270-370 nm.

Since the wavelength of the fluorescent light in the case of minerals is also dependent on the deposit of origin of the materials, it is also possible to make a determination of the relevant deposit by means of filters for the stimulating light and/or by means of filters for the fluorescent light that is to be detected and/or through the appropriate choice of detector for the fluorescent light (for example, a broadband sensitive RGB camera).

For instance, the type of minerals or mineral phases, intergrowth ratios, and at least the superficially visible amounts of specific minerals in the mineral-containing objects can be detected by means of fluorescence stimulation.

The second image can basically be made with any light, since it is only intended to define the individual objects. This second image can be created either in a backlight method, where the transmitted light that passes through the material stream, or that goes through the material stream between the objects in it, is imaged. Or, the second image can likewise be created in an incident light method, where the reflected light of the object is imaged.

The object detection light can in this case (additionally, if UV light is already used as stimulating light) comprise UV light, and/or (additionally, if visible light is used as stimulating light) comprise visible and/or IR light. In the case of the additional light, an additional light source—to the stimulating light source to generate the fluorescence—can be provided. This additional or second light source can primarily emit only UV light, only visible light, or only infrared light. It could also be a light source that emits both UV light and visible light, or that emits both visible and IR light. Of course, the additional or second light course in practice can be formed by a plurality of lamps (tubes, LEDs, etc.).

In order to save costs for light sources, it can be provided that the stimulating light is also used as the object detection light. In this case, the object detection light need not be emitted by its own light source, rather the stimulating light or the stimulating light source, which is/are used for stimulation of fluorescence, is also used for object detection. This basically opens two design possibilities: first, the stimulating light reflected by the object can be recorded in the form of an image by an appropriate detector, which corresponds to an incident light method for the object detection. Second, the stimulating light, after passing between the objects, can be recorded as transmitted light in the form of an image by an appropriate detector, which corresponds to a backlight method for the object detection.

In order to have a clear differentiation between transmitted or reflected object detection light on the one hand and fluorescent light on the other, the object detection light as a rule at least does not lie in the wavelength range of the expected fluorescent light.

As a rule, the first and the second images are created at the same time and the two images can then be directly compared to each other. A small time delay between the recording of the first image and that of the second image would, however, also be possible and could be taken into account or compensated during the image processing.

The first image, with the information on fluorescence, and the second image, with the geometric properties of the object, are combined with each other, as a rule by means of image processing software, if they were created by different detectors, and then processed, and the objects are classified and sorted out by position in time and location in correspondence with the sorting criteria.

In order to keep the number of detectors as low as possible and to simplify the processing of the images, it can be provided that the fluorescent light on the one hand and the transmitted or reflected light of the object detection light on the other are detected with the same detector in the form of a common image. A prerequisite for this is that the fluorescent light differs sufficiently from the transmitted or reflected light of the object detection light and the detector is sufficiently sensitive in the corresponding wavelength ranges. Thus it would, for instance, be conceivable to use a high-sensitivity RGB camera as the only detector per recording to create an image that images the fluorescent light in one color or channel, for example blue, and the transmitted or reflected light of the object detection light in another color or another channel, for example red.

In this way it is not necessary to reconcile a first and a second image for object detection, rather for each position of the object there will be only one image, which contains both the information on the fluorescence and the information on the geometric measurements and position of the object.

Whether the valuable objects are sorted out from the non-valuable objects or vice versa is not important and is dependent, for instance, on which of the two fractions has the greatest proportion of objects, or it is determined through qualitative aspects. The sorting out of a fraction can take place, for instance, by ejecting it with compressed air.

Non-valuable objects will not have any or only a slight intensity in the predetermined wavelength and intensity range that is associated with the fluorescent light of the desired minerals or plastics.

Valuable objects will have a higher intensity than non-valuable objects in the predetermined wavelength and intensity ranges that is associated with the fluorescent light of the desired minerals or plastics.

In many objects, the desired mineral or the desired plastic is not uniformly distributed through the object, rather there are regions that consist only of the desired mineral or plastic and regions that do not exhibit the desired mineral or the desired plastic at all. For instance, a mineral object can have a region that consists entirely of the desired mineral and another region that consists entirely of a different material. In the case of plastic objects like plastic wastes, in just the same way an object, for example an upper part of a plastic bottle, could consist entirely of a desired plastic, for example the bottleneck itself, and a part of a different plastic, for example the screw cap, which is still screwed onto the bottle neck.

In this respect it can be provided that the image of an object is divided into several partial regions, and a partial region is defined as containing a specific mineral (namely the valuable mineral) or a specific plastic if the fluorescent light from said partial region lies in a predetermined wavelength and intensity range, since then at least said partial region consists of the desired mineral or plastic.

The method according to the invention can be refined still further by also taking into account the mineral or plastic content in an individual object. For example, it can be desirable to define such objects only as value-containing and to further the process with those that exceed a specific fraction of desired mineral or plastic. The larger and/or the more often the fluorescent points appear in the image of an object, the more desired minerals or desired plastic said object will contain. Thus, to obtain only objects that are relatively rich in the valuable mineral or desired plastic, it can be provided that an object with only very few or none of the so-called "fluorescence spots" will be defined as non-valuable.

In this respect it can be provided that an object is defined as containing a specific material or a specific plastic if the sum of the partial regions that contain the specific mineral or the specific plastic exceeds a predetermined threshold value of the intensity with respect to a reference surface such as the overall surface of the image of the object. Thus, for example, the fluorescent image points (fluorescent pixels) exceeding a defined threshold value for an object are added together in the fluorescent light image and put into a ratio with the surface of the object, thus the number of pixels of the object in the second image. Only if the ratio exceeds a predetermined value will the object be seen as valuable and sorted into the corresponding fraction.

Since fluorescence is a surface effect, one obtains better results, i.e., higher fluorescent light intensities, if the fluorescent light is measured in an incident light method. This means that the stimulating light source or stimulating light and detector for the fluorescent light are located on the same side of the object. However, there are also advantages to measurement of the fluorescent light in a backlight method, where the detector in this case is on the opposite side of the stimulating light source and measures the fluorescent light passing through the object and emitted by the object. However, the backlight method can only be employed if the objects are transparent to the fluorescent light, which is not the case for many minerals or mineral intermediate and end products.

Of course, a combination of incident and backlight detectors is also possible for detection of the fluorescent light.

It is advantageous if, because of the intensity of the fluorescent light in the predetermined intensity range for objects containing a specific mineral or a specific plastic, a further subdivision of said objects with respect to mineral content or plastic content is carried out. In this way, at least two classes of valuable objects could be filtered out, one with a lower and one with a higher mineral content or plastic content. This is particularly readily possible in an incident light method, since the intensities are fundamentally higher here.

One embodiment of the invention calls for the stimulating light and/or the additional light to be pulsed. The objects therefore are not continuously illuminated, rather the additional light is switched on only when the image is being detected. This has the advantage that less energy is consumed overall than with continuous illumination of the objects, and nevertheless higher intensities can be used for the brief illumination than in the case of continuous illumination, and even weakly fluorescent materials can be detected through this.

The sorting plant for conducting the method according to the invention is characterized in that it comprises at least the following:

- a stimulating light source, with which a single layer material stream of objects can be illuminated,
- a first detector for detection of the fluorescent light generated in the object by the stimulating light source, in the form of an image,
- a device for creating an image of the individual objects,
- a device for producing a single layer material stream of objects, with which the material stream can be transported past the stimulating light source, and
- a device for sorting, which then defines an object as containing a specific mineral or a specific plastic and separates it from other objects of the material stream when the fluorescent light of said object lies in a predetermined intensity range for at least one predetermined wavelength range.

The device for creating an image of the individual objects can comprise the following:

- a second light source, which can emit UV light and/or visible and/or IR light outside of the fluorescent light, and/or
- a second detector for detecting the transmitted light of the optional second light source or the stimulating light source, after passage between the objects, or to detect the reflected light of the objects irradiated by the optional second light source or the stimulating light source.

Both the first and the second detectors can be designed as optical cameras, for example as line scan or area scan cameras. The device for producing a single layer material stream can, for example, be a conveyor belt, or a plate that is tilted in the operating state of the sorting plant; if the backlight method is used, the plate must be appropriately light-permeable (see FIG. 2) or must otherwise end immediately before the detection area (see FIG. 6).

For implementation of the incident light method for the fluorescent light, it can be provided that the stimulating light source and the first detector are situated on the same side of the material stream.

In order to be able to use the stimulating light also for object detection in the case of UV light, it can be provided that the second detector is a UV detector.

In order to be able to detect both the fluorescence and the geometric properties of the objects when using a single detector, one can provide a second light source, which can emit visible and/or IR light. Then both the fluorescent light and the transmitted or reflected object detection light (originally emitted by the second light source) can be recorded at the same time by the same detector.

The expression "using a single detector" does not exclude that a plurality of like detectors may be used, for example side by side, each of which can detect both the fluorescent light and also the transmitted or reflected object detection light, for instance when the entire width of the material stream cannot be encompassed with a single detector. Also, the devices called the first and second detector can in practice each be made of a plurality of like detectors if this is necessary, for instance because of the width of the material stream.

Said preferred embodiments for the sorting plant according to the invention result in at least the following arrangements of light sources and detectors, where the "object side" always means the side of the device for producing a single layer material stream (for example conveyor belt, plate, slide), on which the objects to be sorted are situated:

First Arrangement:

- at least one stimulating light source for the stimulating light, on the object side
- at least one detector for fluorescent light, on the object side (incident light method)
- at least one second light for the object detection light, on the object side
- at least one second detector for the reflected object detection light on the object side (incident light method), see in this regard FIG. 1.

Second Arrangement:

- at least one stimulating light source for the stimulating light, on the object side
- at least one detector for fluorescent light, on the object side (incident light method)

at least one second light source for the object detection light, opposite the object side at least one second detector for the transmitted object detection light, the second light source lying opposite, thus on the object side (backlight method), see in this regard FIG. 2.

Third Arrangement:

at least one stimulating light source for the stimulating light, on the object side at least one detector for fluorescent light, on the object side (incident light method)

at least one second light for the object detection light, on the object side at least one second detector for the transmitted object detection light, lying opposite the second light source, thus opposite the object side (backlight method).

Fourth Arrangement:

at least one stimulating light source (UV and/or visible light) for the stimulating light and for the object detection light, on the object side at least one detector for fluorescent light, on the object side (incident light method)

(no second light source for the object detection light)

at least one second detector for the transmitted object detection light, thus the light of the stimulating light source, either lying opposite the stimulating light source, thus opposite the object side (backlight method), or on the object side (incident light method).

Fifth Arrangement:

at least one stimulating light source for the stimulating light, on the object side at least one second light source for the object detection light, opposite the object side at least one detector, on the object side, for joint detection of fluorescent light (incident light method) and object detection light transmitted between the objects (backlight method)

(no second detector just for the transmitted object detection light).

Sixth Arrangement:

at least one stimulating light source for the stimulating light, on the object side, a second light source for the object detection light, also on the object side, at least one detector, on the object side, for joint detection of fluorescent light (incident light method) and reflected object detection light (incident light method)

(no second detector only for the reflected object detection light).

In order to make the device according to the invention in a design that saves as much space as possible, it can be provided that the stimulating light source and the optional two light sources are situated in a common housing, if both are on the same side of the device for producing a single layer material stream, and/or that the first and optionally second detector are in a common housing, if both are on the same side of the device for producing a single layer material stream.

If UV light is used as stimulating light, in order to be able to eliminate undesirable wavelengths from the spectrum of the UV light source, in particular wavelengths of visible light, the UV light should be filtered. For this it can be provided that the UV light source is incorporated into a housing with at least one mirror filter so that the light from the UV light source is deflected and filtered through at least one mirror filter, in particular is deflected by 180° through two mirror filters arranged perpendicular to each other.

Since the method according to the invention can be implemented on an industrial scale only with computer support, in particular using image-processing programs to define the individual objects, the present invention also comprises a computer program product, which comprises a program and can be loaded directly into a memory of a central computer of a sorting plant, with program means to implement all steps of the method when the program is implemented by the central computer. The program can, for example, be stored on a data carrier, on a storage medium, or on another computer-readable medium, or can be made available as a signal via a data link.

In particular, the program will process the image of the fluorescence points and the image of the individual objects and then define an object as containing at least a specific mineral or a specific plastic if the fluorescent light of said object lies in a predetermined intensity range for at least one predetermined wavelength range, and the program will cause objects defined in this way to be separated from other objects of the material stream. In addition, the program could also conduct the method steps of Claims 5, 6, and 8.

BRIEF DESCRIPTION OF THE FIGURES

The invention will now be explained in more detail by means of schematic drawings that represent embodiment examples of a device according to the invention. In each case, the incident light method is used for the stimulating light, i.e., the stimulating light source and detector for fluorescent radiation are disposed on the same side of the material stream.

EMBODIMENTS OF THE INVENTION

Figure 1:
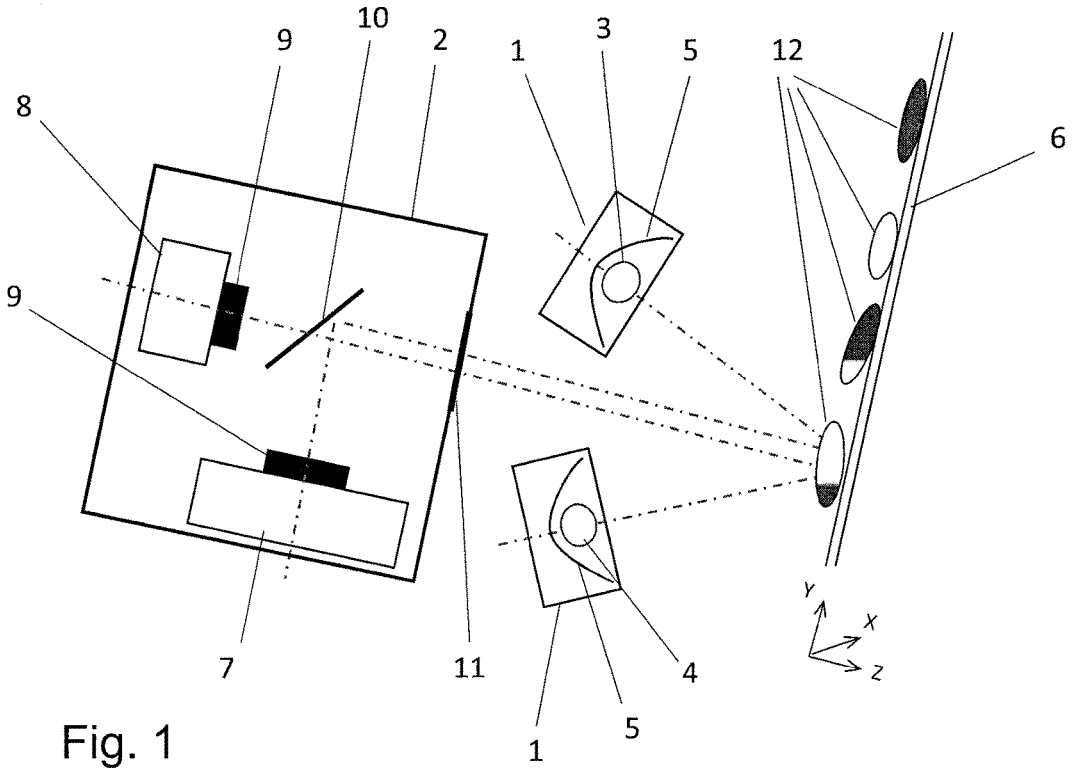
FIG. 1 shows a sorting plant according to the invention using the incident light method for both light sources.

In FIG. 1, a UV light source 3 is built into a first housing 1 for light sources and a second light source 4 is built into a second housing 1 for light sources.

The UV light source 3 here can emit UVC light in the 200 to 280 nm range, in particular with a maximum intensity at a wavelength of 254 nm. The light intensity at the level of the objects 12 can be 1.0 to 1.5 mW/cm$^2$. The UV light source 3 can be made in the form of a UVC light, which is also called a UVC fluorescent lamp or UVC fluorescent tube. However, the UV light source 3 here can also emit UVA light in the 330 to 400 nm range, in particular with a maximum intensity at a wavelength of 366 nm. The light intensity at the point of the objects 12 can be, for instance, 1.0 to 1.5 mW/cm$^2$. The UV light source 3 can be made in the form of a UVA light, which is also called a UVA fluorescent lamp or UVA fluorescent tube. Or, the UV light source 3 can, for instance in the form of a fluorescent lamp or fluorescent tube, emit UVB light in the 280-330 nm range, in particular with a maximum intensity at a wavelength of 312 nm, likewise with a light intensity at the level of the objects 12 of, for instance, 1.0 to 1.5 mW/cm$^2$.

Instead of a UV tube, it is also possible to use one or more UV LEDs (a so-called LED line). At any rate, UVA LEDs with a maximum wavelength of about 360 nm are currently available, with which a clearly higher light intensity at the site of the objects 12 of about 5.0 to 8.0 mW/cm$^2$ can be achieved.

UVC and UVB LEDs are still very expensive and are obtainable only in limited numbers and with relatively low light intensity.

The second light source 4 here can emit light in the visible range (400-780 nm wavelength) and/or in the infrared range (780-1100 nm wavelength). If the second light source 4 emits visible light, it should also lie outside the expected fluorescent light that is produced by the UV light source 3. Typically, the fluorescent light can lie in the visible blue range, thus 400-500 nm. The second light source 4 can, for instance, as in this example, be made as a fluorescent lamp (Vis light) with wavelengths in the visible and infrared range of 520-1100 nm. Instead of the lamp (Vis light), it is also possible to use one or more color and/or infrared LEDs (LED line).

LEDs have a number of advantages over tube lights:

- better controllability of the intensity
- higher intensity
- many different and also narrow wavelength ranges are possible
- width of illumination (LED line) or illuminated area freely selectable by the arrangement of a plurality of LEDs
- possible to specify an intensity profile The disadvantages, at least of LEDs in the UVC range, are the currently high purchase prices and the higher diffusion expenditure by comparison with tube lights.

The two light sources 3 and 4 could also be disposed in a common housing, but then they must be separated from each other by a light-impermeable separating wall.

In the example in FIG. 1, a UVC light 3 emits UVC radiation with a maximum intensity that is typically at a wavelength of 254 nm and is built into housing 1 so that the UV light is directed toward the objects 12 by a reflector 5 disposed behind the UVC light 3. The UV light can still pass through a filter, which absorbs a large portion of the light in the visible range emitted by the UVC light 3 and thus sends almost no visible light in the wavelength range of the fluorescent light to the detectors 7 and 8. If, for instance, blue light from the UVC light 3 reached the detector 7 for fluorescent light, it would be detected as fluorescent radiation if it likewise lies in the range of blue light.

The Vis light emitted by the second light source 4 can likewise pass through a filter, which absorbs emitted light in the UV and fluorescent range (<500 nm).

The housing 1 of the UVC light 3 consists, at least in the region of the UV light exit, of a quartz glass pane. Quartz glass has very high permeability for UVC light.

However, a quartz glass pane or panel of appropriately light-permeable materials such as standard glass, Borofloat® glass or Plexiglas can also cover the visible light exit.

The glass pane 6 serves as a slide for the tested objects 12. In the mounted state of the device according to the invention, it has a tilt of about 25° to the vertical. The objects 12 on it slide downward and in doing so are illuminated by the two light sources 3 and 4. It is important that the materials of the slide and any coverings for the light passage do not themselves fluoresce.

The spacing between the fluorescent light to be detected and the reflected light to be detected (from the second light source 4) should be as small as possible (preferably, congruent), so that both detectors 7 and 8, the one for fluorescent light and the one for reflected light, can produce an image of the moving objects 12 that matches as closely as possible. The spacing between the central axes of the light beams (represented by a dot-dash line) of the visible/IR light or the UV light, when they exit from the relevant housing 1, is, for instance, 25 mm in this example.

Both the visible/IR light of the Vis light 4 reflected by the objects 12 and the fluorescent radiation in the blue visible range induced by the UV light pass through a protective glass 11 into the additional housing 2 where, on the one hand, a detector 7 for detection of fluorescent light is accommodated and where, on the other hand, the detector 8 for detection of the reflected light of the second light source 4 is also disposed.

The protective glass 11 consists of standard glass or Borofloat® glass and protects the inside of housing 2 against dust and UVC radiation.

The detector 7 for detection of the fluorescent light is sensitive in a wavelength range of 350-1000 nm, and the sensitivity can be narrowed further to the relevant wavelength range through filters. The detector 7 as a rule will be made as a camera. It can be made, for example, as a so-called TDI camera.

To avoid distortion in the detection of the fluorescent light by another light source in this wavelength range, the second light source 4 should, as far as possible, emit only light outside of said frequency range. In practice it is often the case that even light sources in the yellow or red range, which therefore by definition "emit light in the visible range or IR light outside the wavelength range of the fluorescent light," still have a blue component in their light, and this component must then possibly be filtered out, as explained above in the case of the filter for the second light source 4.

For detection of the reflected light from the second light source 4, it is basically sufficient if a detector 8, thus for instance a camera, can provide at least an image of objects in gray shades. From such an image it is then possible to determine the position and shape of the object 12 on the one hand, which is necessary to remove the object from the material stream, optionally by means of connected ejection devices. In addition, it is possible to determine the imaged surface area of the individual object 12, to which the fluorescent regions of the individual object can then be put into a ratio.

The detector 8, as a rule a camera, is for this reason at least sensitive in the wavelength range in which the second light source 4 emits light. In this example, a so-called RGB camera is used. In this camera an RGB signal is processed, thus the colors red, green, and blue are each transmitted or stored in a separate channel.

Basically, a highly sensitive detector is needed to detect the fluorescent light, as a rule a camera, where a so-called TDI camera 7 was used in this embodiment example. This camera contains, like the RGB camera, a CCD sensor, but it contains TDI (Time Delay Integration) elements, which are especially sensitive and nevertheless afford good pictures of moving objects.

Both detectors 7 and 8 have lenses 9 for adjusting the optical properties.

Both fluorescent light and reflected light go to a beam splitter 10, which reflects blue light, for instance in the 400-500 nm wavelength range, as completely as possible and passes visible light >500 nm (reflected light) as completely as possible. The reflected light beam is directed to the TDI camera 7, while the passed light beam goes to the RBG camera 8.

The detected data are sent to an analysis and control unit (not shown), which evaluates the two images and assigns the individual objects to the different fractions and controls the ejection units, which put the objects into the appropriate containers.

Figure 2:
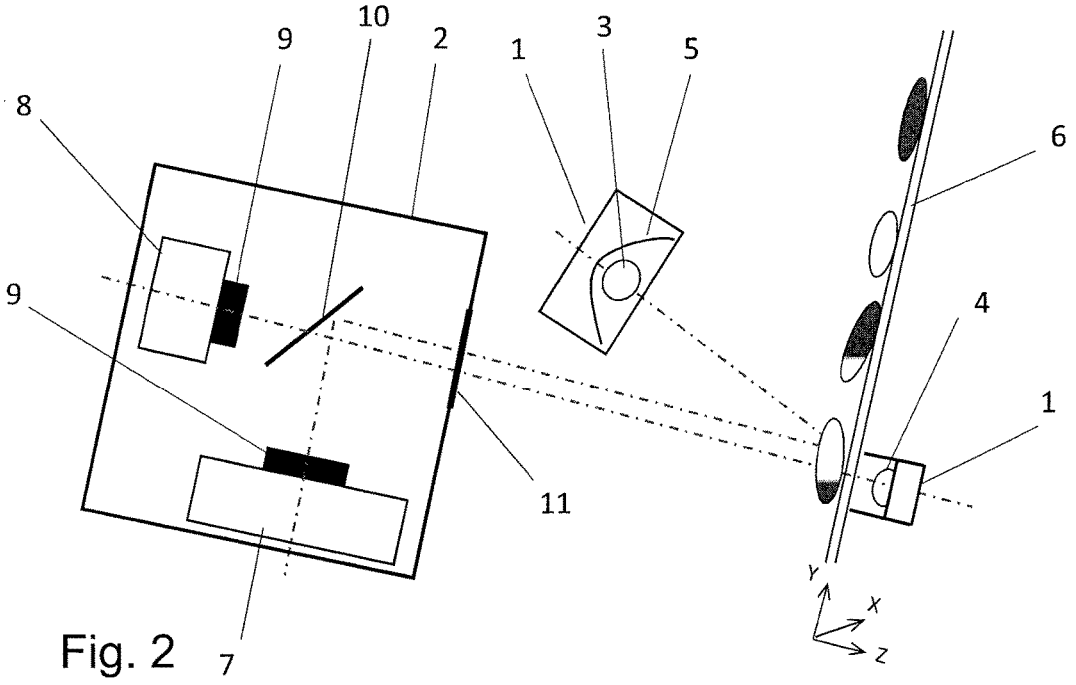
FIG. 2 shows a sorting plant according to the invention using the incident light method for a UV light source as stimulating light source and the backlight method for the second light source.

In FIG. 2, the incident light method is used only for the UV light source 3, while the backlight method is used for the second light source 4. In contrast to FIG. 1, therefore, the second light source 4 is disposed on the other side of the glass pane 6, and the light of the light source 4 thus serves as background lighting. The design and arrangement of the light sources 3 and 4 and the detectors 7 and 8 otherwise corresponds essentially to that of FIG. 1, but the second light source 4 emits NIR light in the 650-850 nm range and is designed as an LED line, the detector 7 for fluorescent light can detect visible light in the 400-650 nm range, and the detector 8 for the transmitted object detection light can detect red and infrared light in the 650-900 nm range.

Figure 6:
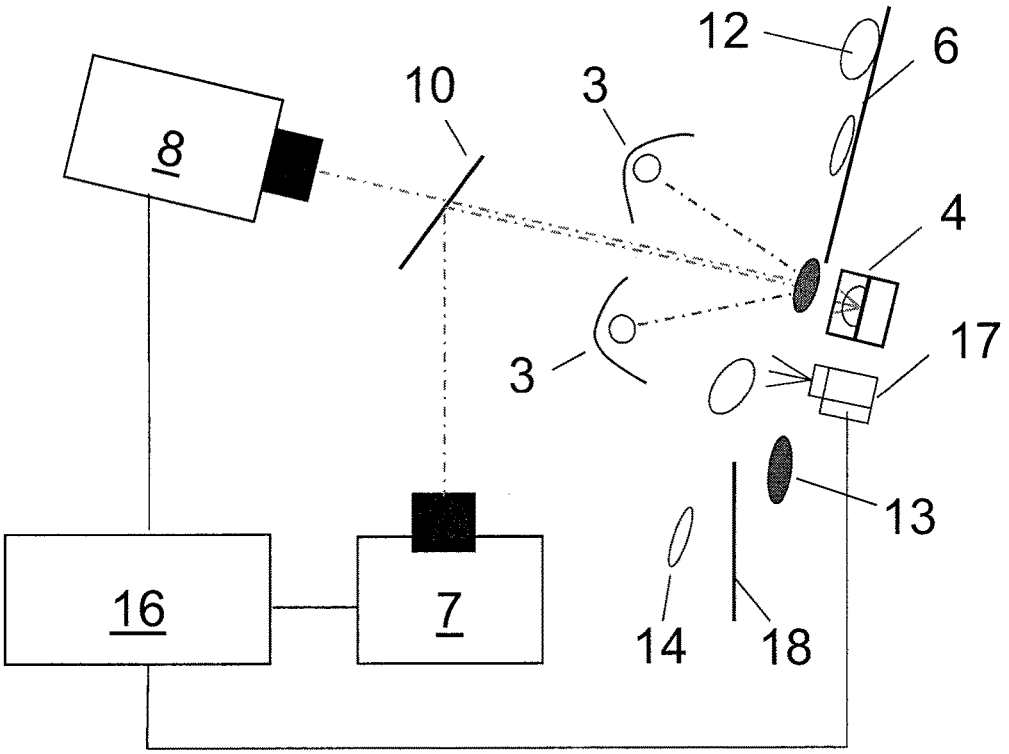
FIG. 6 shows a variant of a sorting plant according to the invention having an alternative arrangement of the device for separation of the material stream and the sensor components with a pneumatic separation device.

It would also be conceivable to provide two UV light sources 3 with different irradiation angles for better illumination of the objects 12, as is shown in FIG. 6.

Figure 3:
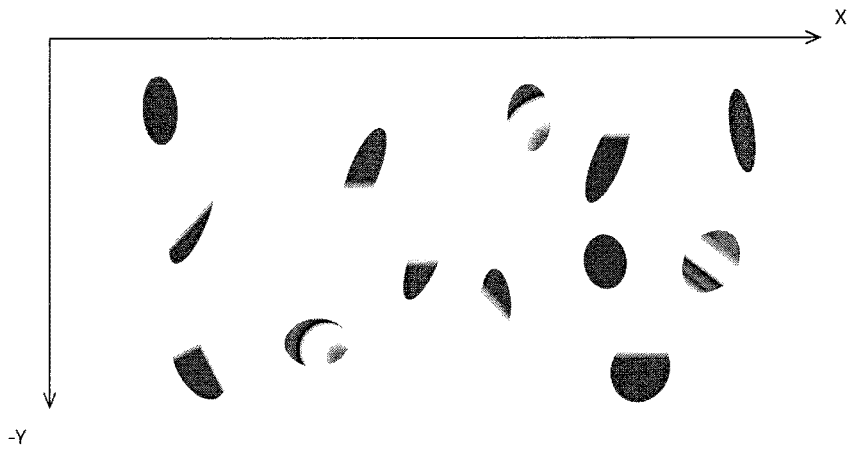
FIG. 3 shows an image of the fluorescent light for a specific arrangement of objects.
Figure 4:
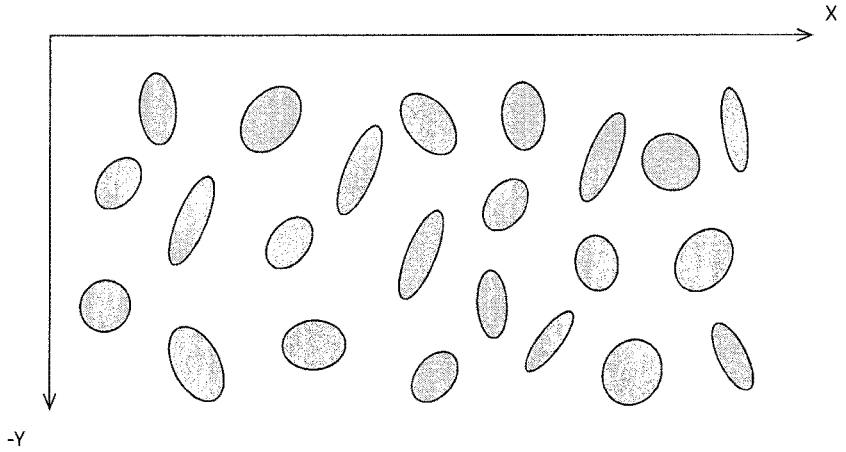
FIG. 4 shows an image of the reflected/transmitted light of the additional light source for the arrangement of the objects in FIG. 3.

FIGS. 3 and 4 each show two-dimensional images of objects 12, which are, as a rule, generated from one-dimensional image lines. Each detector 7 and 8 registers one-dimensional image lines, thus image lines that run across the direction of travel of the objects 12. These image lines are recorded at a high rate, mostly between 1 and 20 kHz, and are assembled into a two-dimensional image, either in the form of a single image or a continuous film of the material stream.

FIG. 3 shows a record segment of the fluorescent light image of the material stream, or of specific objects 12 that have moved through the detection region of the detector 7 on the slide 6 at a specific point in time in FIG. 1 or FIG. 2, respectively, thus in the xy plane in the coordinate system indicated in FIG. 1 and FIG. 2. In this case, the x direction corresponds to the direction across the slide 6, and the negative y direction corresponds to the direction of travel of the objects 12. The speed of travel of the objects 12 is between 1 and 2 m/sec. Image lines are continuously recorded and blocked by detector 7 at a clock rate between 1 and 20 kHz and stored as a record segment. The record segments comprise between 100 and 2000 image lines, so that each object 12 will be seen in at least one record segment or an image on the slide 6.

Also, a film of the objects is divided into segments, in particular overlapping segments, and the segments are then processed further by the image processing software.

The points where fluorescence occurs are shown in dark gray. The points where no fluorescence occurs appear white in this picture, thus the slide 6 itself and the objects 12 and regions of objects 12 that do not consist of fluorescent materials, more precisely that do not exhibit any fluorescence in a wavelength range detected by detector 7. The objects 12 themselves are as a rule not discernible in FIG. 3.

For definition of the objects, one should employ FIG. 4, which shows an image of the same objects 12 (created at the same time), where here at least the geometric shape, shown in light gray, is discernible. This image is created through a record by means of the detector 8.

The creation of the image takes place in the same way as in the case of detector 7, thus through detection of one-dimensional image lines and assembly of the image lines by image processing software, and with a similar, in particular the same, clock rate. Of course, synchronization of the image lines of the two detectors 7 and 8 is useful in order to be able to combine and process the image data with respect to location and time.

Figure 5:
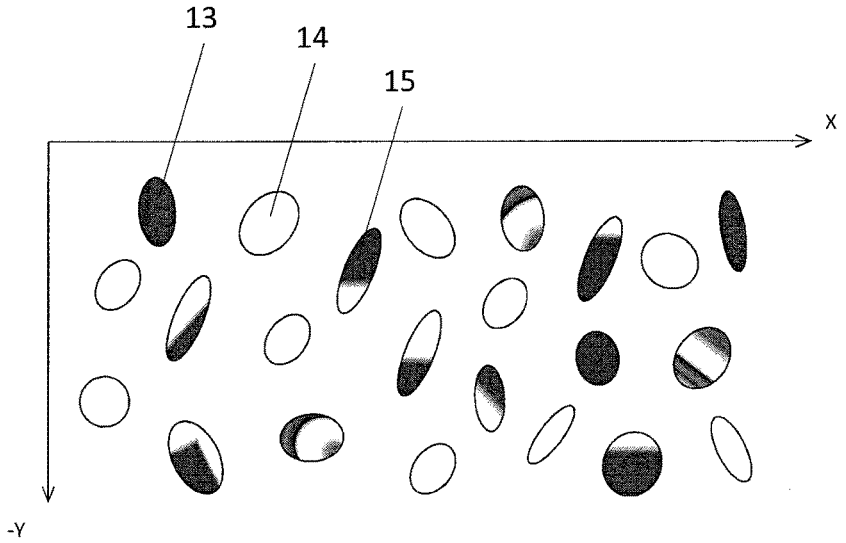
FIG. 5 shows an image of the objects, the fluorescent portions, and their position, thus a superpositioning of FIGS. 3 and 4.

Through analysis of the two images from FIGS. 3 and 4, as shown in FIG. 5, one can determine which object 12 contains how many regions with fluorescence as well as their size and thus the useful mineral or desired plastic, and in addition it is also possible to read the fluorescence intensity. Moreover, the fluorescent surface area of an object can be determined (from the first image, FIG. 3) and the total surface area of the object can be determined (from the second image, FIG. 4), and these surface areas can be put into a ratio with each other for purposes of analysis.

For instance, the entire object 13 consists of a first mineral or plastic, namely one that exhibits fluorescence in the considered wavelength range. The object 14 consists entirely of a second mineral or plastic, which does not exhibit fluorescence in the considered wavelength range. Finally, the object 15 consists partly of a first fluorescent material or plastic and partly of a second nonfluorescent material or plastic.

The exposure time for the fluorescent light detector 7 is, for example, on the order of magnitude of 100 to 1000 microseconds, the exposure time for the visible or IR detector 8 lies in the same order of magnitude or is smaller by a factor of one place, and can even be under 100 microseconds. Thereby a higher image line rate or higher resolution imaging can be achieved.

FIG. 6 shows a variant of a sorting plant according to the invention that is similar to FIG. 2, but has an alternative device for producing a single layer material stream. In FIG. 6, too, the incident light method is used for the UV light sources 3 and the backlight method is used for the second light source 4. Two UV light sources 3 with different exposure angles are arranged symmetrically to the optical axis (indicated by dot-dash line) of the detectors 7 and 8 and contribute to better illumination of the objects 12.

In contrast to FIGS. 1 and 2, in FIG. 6 the inclined glass pane 6 is made short. The background lighting in the form of light source 4, or more precisely the region where its light strikes the objects 12, and the stimulation region, where the UV light of the UV light source 3 strikes the objects 12, are provided in the direction of travel of the objects 12 (from top downward in FIG. 6) after the glass pane 6, thus under the lower edge of the glass panel 6.

This has the advantage that a light-permeable panel material is not necessary, and that the view of the objects 12 in free fall is better for the different variations in positioning of light sources and detectors. In particular, a two-sided fluorescence detection would then be more easily possible, thus a detector 7 for fluorescent light could be provided on both sides of the material stream, which in turn would have the advantage—for objects not permeable to UV light—that the presence of valuable mineral or desired plastic on the other side of the objects can also be tested.

The disadvantage of the shortened panel is that the objects 12 are guided for a shorter time, which can have a negative effect on the ejection efficiency, mainly for small objects.

The design and arrangement of the light sources 3 and 4 and the detectors 7 and 8 otherwise correspond essentially to those in FIG. 2, the second light source 4 emits NIR light in the 650-850 nm range and is made as an LED line, the detector 7 for fluorescent light can detect visible light in the 450-650 nm range, and the detector 8 for the transmitted object detection light can detect red and infrared light in the 650-85 nm range.

FIG. 6 additionally shows the connection of the detectors 7 and 8 to an analysis and control unit 16, as a rule a computer, which can form, for example, the central computer of a sorting plant, and which implements the computer program according to the invention. Said analysis and control unit 16 compiles the image lines of detectors 7 and 8 into images and conducts the analysis according to the invention, as explained in connection with FIGS. 3-5.

The ejection units, as in this case one or more blast nozzles 17, are controlled in dependence on this evaluation. The nozzles are disposed under the glass panel 6 (or a panel of nontransparent material) and below the region where the objects 12 are illuminated. Objects 13 (or additionally also objects 15), which contain sufficient amounts of a first mineral, the valuable mineral (or a desired plastic) fall downward undisturbed into a region to the right of a dividing wall 18. Objects 14, which do not (or insufficiently) contain a first mineral, the valuable mineral (or the desired plastic), rather consist entirely (or mostly) of a second mineral (or plastic) are blown by the blast nozzles 17 and deflected into a second region to the left of the dividing wall 18.

It would also be conceivable to separate the objects 12 into three fractions, where the valuable objects are divided further into a fraction with a high content of valuable material or desired plastic, like object 13 in FIG. 5, and a fraction with a low content of valuable material or desired plastic, like object 15 in FIG. 5.

Figure 7:
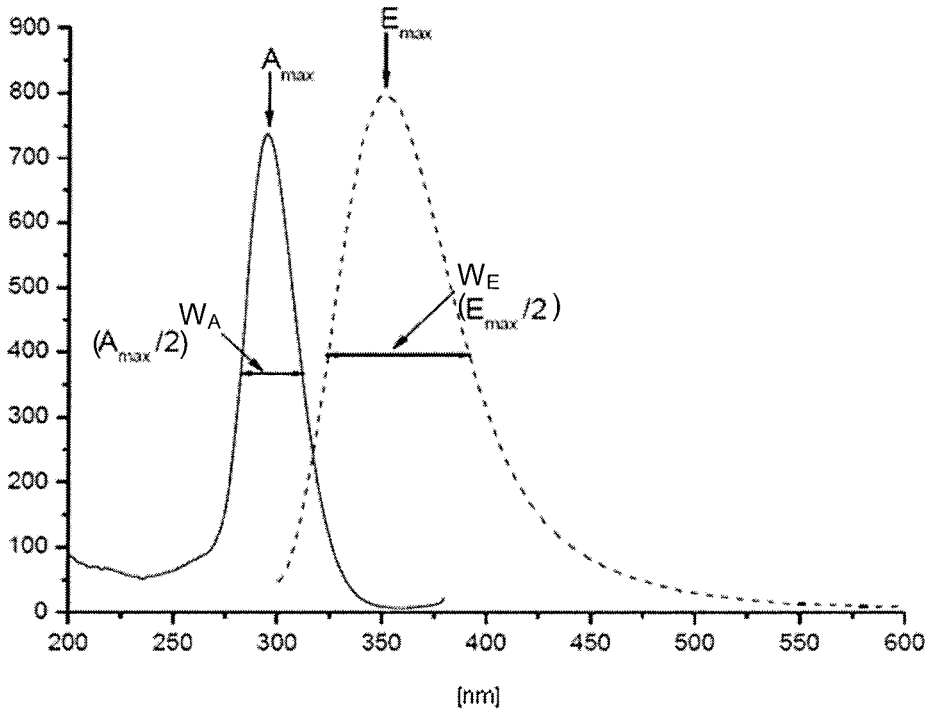
FIG. 7 shows a diagram representing the intensity of the stimulating light and fluorescent light in dependence on the wavelength.

FIG. 7 shows a diagram in which the wavelength of the light is plotted in nm on the horizontal axis and the relative intensity of the light is plotted on the vertical axis. The solid curve represents the stimulating light A, while the broken curve represents the fluorescent light E. In each case, only the intensity curves that contains the peak is shown. The representation concerns a specific material, and the maximum fluorescence intensity is obtained at wavelength $E_{max}$ when the stimulation takes place at a wavelength that corresponds to the stimulation peak $A_{max}$.

The peak $A_{max}$ of the stimulation peak of the stimulating light A in this example is at a wavelength of 300 nm. The wavelengths at which the intensity has fallen to half of the peak $A_{max}$ define the width $W_A$ of the stimulation peak. In the method according to the invention, the stimulating light should lie within this width so that the fluorescent light exhibits sufficient, namely detectable, fluorescence. The wavelengths that establish the width $W_A$ of the stimulation peak here are 280 nm and 320 nm, the width $W_A$ of the stimulation peak therefore is 40 nm or relative to the peak $A_{max}$±20 nm.

The peak $E_{max}$ of the fluorescence peak of the fluorescent light E in this example is at a wavelength of 350 nm. The wavelengths at which the intensity has fallen to half of the peak $E_{max}$ define the width $W_E$ of the fluorescence peak. In the method according to the invention, the fluorescent light should lie within this width, so that sufficient fluorescence is present. The wavelengths that establish the width $W_E$ of the fluorescence peak here are 325 nm and 390 nm, the width $W_A$ of the stimulation peak therefore is 65 nm or relative to the peak $E_{max}$+40/−25 nm.

Examples of pairs of stimulation and fluorescence peaks for specific materials and for the case where the wavelength of the fluorescent light for specific materials can also be dependent on the deposit of origin of the materials can be seen in the following table.

Here the relevant material is listed in the first column, thus the mineral or plastic. The second column lists the stimulation wavelength or the wavelength range in which a stimulation should take place, and, in correspondence with FIG. 7, the width $W_A$ of the stimulation peak is given in the form of a positive and negative difference to the stimulation wavelength (the peak=the main peak). The third column lists the emission wavelength (wavelength of the fluorescent light) or the emission wavelength range in which a fluorescence can be detected, and, in correspondence with FIG. 7, the width $W_E$ of the fluorescence peak is given in the form of a positive and negative difference to the emission wavelength (the peak=the main peak).

| Material (Mineral, plastic) | Stimulation wavelength or wavelength range (Main peak, ± delta at main peak/2) | Emission wavelength or wavelength range (Main peak ± delta at main peak/2) |
|---|---|---|
| Scheelite (Tungsten) - Austria | 254 nm | 430 nm +80/−50 |
| Fluorite - Germany | 366 nm | 425 nm +20/−10 |
| Fluorite - Turkey | 366 nm | 500 nm +100/−80 |
| Ruby, corundum - Mozambique | 410 nm +30/−30<br>565 nm +40/−50 | 690 nm +10/−5 |
| Calcite (limestone) - Indonesia | 254 nm<br>366 nm | 620 nm +50/−70<br>620 nm +40/−70 |
| Calcite (limestone) - Austria | 254 nm<br>366 nm | 440 nm +140/−50<br>560 nm +90/−80 |
| Calcite (limestone) - Norway | 254 nm<br>366 nm | 615 nm +65/−45<br>600 nm +60/−40 |
| Magnesite - Brazil | 366 nm | 640 nm +40/−40 |
| Magnesite - Turkey | 254 nm | 465 nm +105/−75 |
| Apatite (concentration) - | 254 nm | 500 nm +40/−35 |
| PET | 254 nm | 400 nm +30/−45 |
| PE-HD | 254 nm | 405 nm +35/−30 |
| PP | 254 nm | 405 nm +80/−30 |

For some materials such as calcite, fluorescence can be stimulated at two different wavelengths and therefore there will be two stimulation peaks. There will then be either one fluorescence peak (ruby, corundum) or two fluorescence peaks (calcite).

Should the data listed in the table not yet be known (or not known sufficiently accurately) for a specific material to be sorted, before conducting the method according to the invention, it would be appropriate to conduct a spectral measurement with narrow-band stimulation, for example in steps of 1-10 nm, in order to establish the wavelengths and intensities for the stimulating light and the fluorescent light that is to be detected.

The peak wavelengths listed in the table are fluorescence-active and are characteristic for industrially readily available stimulating light sources.

REFERENCE NUMBER LIST

1 Housing for light source
2 Housing for detectors
3 Stimulating light source (UV light source (UVC light))
4 Second light source (Vis light)
5 Reflector
6 Glass pane (slide)
7 Detector for detection of fluorescent light (TDI camera)
8 Detector for detection of object detection light (RGB camera)
9 Lens
10 Beam splitter
11 Protective glass
12 Object
13 Object of first mineral or plastic
14 Object of second mineral or plastic
15 Object containing first and second mineral or containing first and second plastic
16 Analysis and control unit (device for sorting out)
17 Ejection nozzle (device for sorting out)
18 Dividing wall (device for sorting out)
A Stimulating light
$A_{max}$ Peak of stimulation peak
E Fluorescent light
$E_{max}$ Peak of fluorescence peak
$W_A$ Width of stimulation peak
$W_E$ Width of fluorescence peak

The invention claimed is:

1. A method for sorting out mineral-containing objects or plastic objects from a single layer material stream of objects, characterized in that the objects of the material stream are irradiated with stimulating light, and resulting fluorescent light from any of the objects irradiated with the stimulating light is in a wavelength range and is detected in the form of an image of fluorescent points in a first detector, the objects of the material stream are irradiated with object detection light at a wavelength range outside the wavelength range of the fluorescent light, and transmitted object detection light after passage between objects is detected in the form of an image of individual objects in a second detector, an object is then defined as containing at least a specific mineral or a specific plastic when a said fluorescent point or points in the image of fluorescent points correlated with of a said individual object in the image of individual objects lies in a predetermined intensity range for at least one predetermined wavelength range, and objects defined in this way are separated from other objects of the material stream.

2. The method as in claim 1, characterized in that the stimulating light is UV light.

3. The method as in claim 1, characterized in that the stimulating light is visible light.

4. The method as in claim 1, characterized in that the object detection light comprises additional UV light, and/or visible and/or IR light.

5. The method as in claim 1, characterized in that the stimulating light is also used as object detection light.

6. The method as in claim 1, characterized in that the image of an object is divided into a plurality of partial regions and a partial region is defined as containing a specific mineral or a specific plastic when the fluorescent light from said partial region lies in a predetermined wavelength and intensity range.

7. The method as in claim 6, characterized in that an object is defined as containing a specific mineral or a specific plastic if the sum of the partial regions that contain the specific mineral or specific plastic, in a ratio to a reference surface, exceeds a predetermined threshold of the intensity.

8. The method as in claim 1, characterized in that the fluorescent light is measured in an incident light method.

9. The method as in claim 1, characterized in that on the basis of the intensity of the fluorescent light in the predetermined intensity range for objects containing a specific mineral or a specific plastic, a thither subdivision of said objects with respect to mineral content or plastic content is carried out.

10. The method as in claim 1, characterized in that the stimulating light and/or the additional light is/arc pulsed.

11. A sorting plant for conducting a method as in claim 1, characterized in that the sorting plant comprises at least a stimulating light source for generating the stimulating light, with which the single layer material stream of objects can be illuminated, a first detector for detection of fluorescent light generated in an object by the stimulating light from the stimulating light source, in the form of the image of the fluorescent points, a device for creating the image of the individual objects, a device for producing the single layer material stream of objects, with which the material stream can be transported past the stimulating light source, and a device for sorting out, which then defines an object as containing a specific mineral or a specific plastic and separates the defined object from other objects of the material stream if the fluorescent light of a said object lies in a predetermined intensity range for a predetermined wavelength range; and that the device for creating an image of the individual objects comprises;

a second detector for detection of the transmitted light from an optional second light source or the stimulating light source, after passing between the objects, and the optional second light source can emit UV light and/or visible and/or IR light outside the wavelength range of the fluorescent light.

12. The sorting plant as in claim 11, characterized in that the stimulating light source and the first detector are situated on the same side of the material stream.

13. The sorting plant as in claim 11, characterized in that the second detector is a detector for UV light.

14. The sorting plant as in claim 11, characterized in that another light source that can emit visible and/or IR light is provided.

15. A computer program product, which comprises a program and can be loaded directly into a memory of a central computer of a sorting plant, with program means in order to implement all steps of the method according to claim 1 when the program is implemented by the central computer, where the steps are that the image of the fluorescent points and the image of the individual objects are processed, and that an object is defined as containing at least one specific mineral or one specific plastic when the fluorescent light of one or more of the fluorescent points correlated to a said object lies in a predetermined intensity range for at least one predetermined wavelength range, and the so defined objects are caused to be separated from the other objects of the material stream.

16. The method of claim 7 wherein the reference surface comprises total surface of the image of the object.

* * * * *